US005967142A

United States Patent [19]

Dorcheh et al.

[11] Patent Number: 5,967,142

[45] Date of Patent: Oct. 19, 1999

[54] METHOD FOR CONNECTING TWO COMPONENTS, ESPECIALLY IN THE ASSEMBLY OF DIAPHRAGM VALVES

[75] Inventors: Jazini Dorcheh; Desmond T. Curran, both of Durham, United Kingdom

[73] Assignee: Minnesota Mining and Manufacturing Company, St. Paul, Minn.

[21] Appl. No.: 08/806,267

[22] Filed: Feb. 24, 1997

(Under 37 CFR 1.47)

[51] Int. Cl.[6] ..... A62B 7/00

[52] U.S. Cl. ..... 128/206.15; 128/206.17

[58] Field of Search ..... 264/249; 128/206.12, 128/206.17, 206.15; 411/502, 503, 501

[56] References Cited

U.S. PATENT DOCUMENTS

| | | |
|---|---|---|
| 4,790,306 | 12/1988 | Braun et al. . |
| 4,934,362 | 6/1990 | Braun . |
| 5,033,465 | 7/1991 | Braun et al. . |
| 5,052,084 | 10/1991 | Braun . |
| 5,578,132 | 11/1996 | Vilzinann . |

FOREIGN PATENT DOCUMENTS

| | | |
|---|---|---|
| 316743 | 8/1929 | United Kingdom . |
| 1171498 | 11/1969 | United Kingdom . |
| 2068175 | 8/1981 | United Kingdom . |
| 2150474 | 7/1985 | United Kingdom . |
| 2255741 | 11/1992 | United Kingdom . |

*Primary Examiner*—John G. Weiss
*Assistant Examiner*—Charles W. Anderson

[57] ABSTRACT

A valve diaphragm 14 is connected to a valve base 11 by locating the diaphragm on upstanding posts 18 which are formed integrally with the valve base, and then cutting and simultaneously deforming the posts to secure the diaphragm in position. The cutting/deforming operation involves: forming two longitudinal cuts in each post, defining a central section 21 and two outer deformable sections 22, 23; and bending the deformable sections outwards, away from the central section.

5 Claims, 3 Drawing Sheets

METHOD FOR CONNECTING TWO COMPONENTS, ESPECIALLY IN THE ASSEMBLY OF DIAPHRAGM VALVES

TECHNICAL FIELD

The present invention relates to a method of connecting together two components and is applicable especially, but not exclusively, to the assembly of diaphragm valves.

BACKGROUND

Diaphragm valves, comprising a flexible diaphragm mounted on a matching valve base, are used in many fields as one way valves. Typically, the diaphragm is positioned over one or more apertures in the valve base and is secured in such a way that a relative decrease in pressure on the diaphragm side of the base causes the diaphragm to lift away from the base, thereby opening the apertures whereas a relative increase in pressure causes the diaphragm to be pressed against the base, thereby closing the apertures. Diaphragm valves of that type are used, for example, in the field of personal respiratory protection devices where they may be employed as both inhalation and exhalation valves.

In one known type of respirator, in which diaphragm valves are used as inhalation valves, the valve diaphragms are mounted on respective filter assemblies through which air enters the respirator when the wearer breathes in. The filter assemblies are located in the cheek areas of the face piece of the respirator and incorporate a filter material through which inhaled air must pass before it reaches the inhalation valve. The filter material is chosen having regard to the intended use of the respirator and may serve to remove particulate material and/or noxious gases or vapours from the inhaled air. The face piece also incorporates, in the nose and mouth area, an exhalation valve through which air leaves the respirator when the wearer breathes out. The exhalation valve is designed to close when the wearer breathes in so that air enters the respirator through the inhalation valves and must pass through the filter material. Likewise, the inhalation valves are designed to close when the wearer breathes out so that exhaled air leaves the respirator through the exhalation valve and does not contact the filter material.

A filter assembly of a respirator of that type may comprise a moulded plastics casing in which the filter material is contained, the casing being formed with at least one intake aperture on the side adjacent the interior of the face piece of the respirator. The flexible diaphragm of the inhalation valve is secured over the aperture(s) on the inside of the face piece in such a way that, when the wearer breathes in, the diaphragm lifts away from the aperture(s) to allow the entry of air to the respirator. When the wearer breathes out, however, the diaphragm is pushed against the filter assembly so that it covers over and seals the intake aperture(s). To facilitate respirator manufacture, it is clearly desirable to be able to secure the diaphragm to the filter assembly by an automated process.

One procedure which is used for securing inhalation diaphragms to respirator filter assemblies is ultrasonic welding. To that end, the moulded plastics casing of a filter assembly is formed with at least one upstanding post which, when the inhalation diaphragm is positioned on the filter assembly, projects through an aperture in the diaphragm. The end of the post is then softened and enlarged using ultrasonic energy to form a head which holds the diaphragm in position on the filter assembly. Although that procedure works well, it must be carried out by trained operators and is, therefore, comparatively expensive. It also tends to be more time consuming than other parts of the manufacturing process and, consequently, limits the efficiency of respirator production.

As an alternative to the use of posts which are formed integrally with the casings of the filter assemblies, separate fixing pins are available which comprise an enlarged head for retaining the pin in the casing and a centrally-split stem which is first inserted through an aperture in the diaphragm valve and is then spread open to hold the diaphragm in position. The use of such separate fixing pins eliminates the need to use ultrasonic welding techniques but is more complex because it involves a greater number of components.

SUMMARY

The present invention provides a method of connecting together two components using a post which is retained on a first one of the components and projects through the second component, the method comprising the steps of (a) forming at least one longitudinally-extending cut in the projecting end portion of the post, thereby forming at least one deformable section in that end portion; and, simultaneously (b) bending the/each of the deformable section of the post outwards, to secure the second component to the first component.

In one embodiment, two generally parallel cuts are formed in the protecting end portion of the post, defining a central section between the cuts and two outer deformable sections, one on each side of the central section. The outer sections are bent outwards, away from the central section, to secure the second component to the first component. Preferably, the deformable section(s) is bent by the application of pressure without heat.

The first and second components may be, respectively, a valve base and a valve diaphragm. More specifically, the valve base may be the valve casing of a personal respiratory protection device.

A tool for use in a method as defined above may comprise a cutting edge positioned to form a longitudinally-extending cut in the post, and at least one curved surface extruding outwardly from the cutting edge to engage and bend the deformable section(s) of the post.

The present invention also provides an assembly comprising first and second components which are secured together by a post which is retained in a first one of the components and projects through the second component, the projecting end of the post being slit longitudinally into a central section and two deformable outer sections, one on each side of the central section, the deformable sections being bent outwards away from the central section to secure the second component to the first component.

DETAILED DESCRIPTION OF THE PREFERRED EMBODIMENTS

Figure 1:
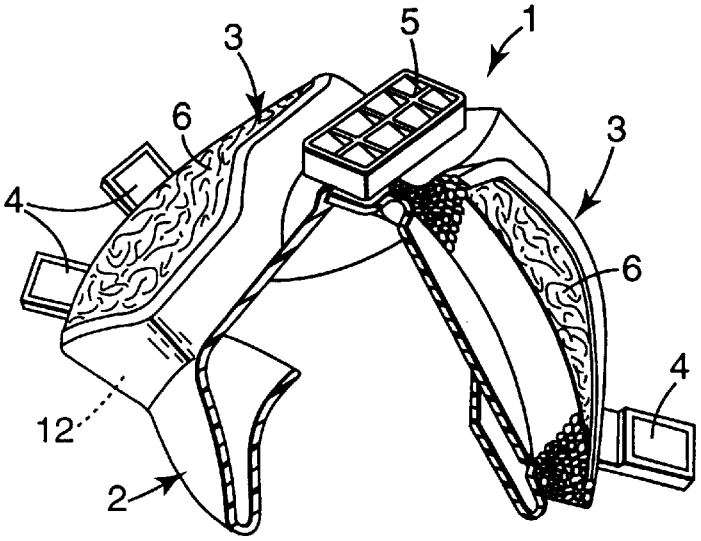
FIG. 1 is a perspective view, partly cut away, of a respirator incorporating inhalation diaphragms mounted on filter assemblies.

FIG. 1 shows a respirator 1 comprising a face piece 2 which incorporates, in the cheek areas, filter assemblies 3 through which air enters the respirator when the wearer breathes in. Buckles 4 extend from the filter assemblies 3 to enable a headband (not shown) to be attached to the respirator. The face piece 2 also incorporates, in the nose and mouth area, an exhalation valve 5 through which air leaves the respirator when the wearer breathes out. The face piece 2 may be formed by moulding from a flexible material, for example a rubber material. A suitable material for the face piece 2 is available, under the trade name "Evoprene", from Evode Plastics Limited of Leicester, England.

Each filter assembly 3 comprises a casing which, on the inner side of the respirator, carries an inhalation valve and, on the outer side, contains a filter material 6 through which inhaled air must pass before it reaches the inhalation valve. The casings of the filter assemblies 3 and the inhalation valves are not visible in FIG. 1 but are described in greater detail below. The filter material 6 is chosen having regard to the intended use of the respirator and serves to remove particulate material and/or noxious gases or vapours from the inhaled air. The exhalation valve 5 is designed to close when the wearer breathes in so that air which enters the respirator must pass through the filter material. Likewise, the/each inhalation valve is designed to close when the wearer breathes out so that the filter material is not exposed to the exhaled air.

A respirator of the type shown in FIG. 1 can be produced by an insert moulding operation which involves placing two filter assemblies 3 (each carrying an inhalation valve) and one exhalation valve 5 in an appropriately-shaped injection mould, and then injecting a suitable material into the mould to form the face piece 2 with the filter assemblies and exhalation valve being simultaneously moulded into position.

A respirator of the same general type as that shown in FIG. 1 is described in US-A-4 790 306, to which reference may be made for further information.

Figure 2:
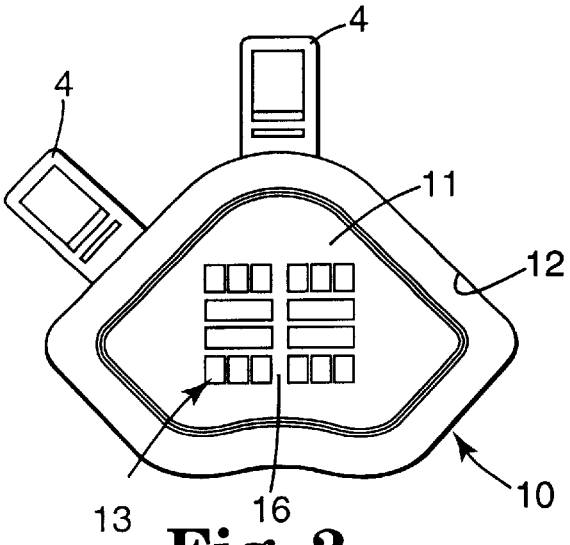
FIG. 2 shows a casing of a filter assembly, as from the outside of the respirator.
Figure 3:
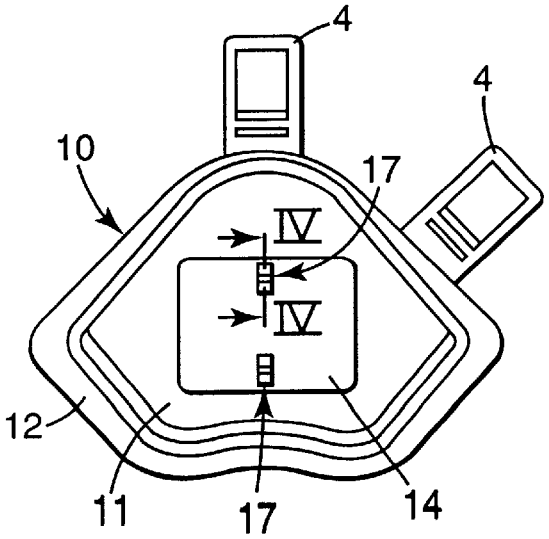
FIG. 3 shows the casing of FIG. 2, as from the inside of the respirator.

FIGS. 2 and 3 show the casing 10 of a filter assembly 3 of the respirator 1. The casing 10, which includes the buckles 4 for the headband of the respirator, is a moulded component formed, for example, of polypropylene or any other suitable plastics material. The base 11 of the casing 10 is curved to lie adjacent the cheek of the wearer and is shaped so that it extends around the end of the mouth and to one side of the nose at its front edge, follows the line of the cheek bone underneath the eye at its upper edge, follows the line of the jaw bone at its lower edge and passes in front of the ear at its rear edge. An upstanding peripheral wall 12 (which also appears in FIG. 1, covered by the moulded material of the face piece 2) defines an enclosed area on the outer side of the base 11, in which the filter material 6 (FIG. 1) is located. The buckles 4 of the respirator extend outwards from the top edge of the wall 12.

Figure 7:
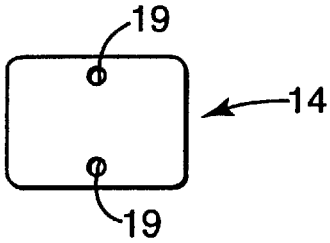
FIG. 7 is a plan view of an inhalation valve before it is located on a filter assembly.

In the central region of the base 11 of the casing 10 is a rectangular array of apertures 13 through which air can be drawn into the respirator, through the filter material 6. An inhalation diaphragm 14 (shown also in FIG. 7), comprising a rectangular piece of flexible rubber material, is secured over the array of apertures 13 on the inner side of the base 11 (FIG. 3). The diaphragm 14 is large enough to cover the array of apertures 13 and is secured in place at two locations to a central bar 16 of plastics material extending across the array. The manner in which the diaphragm 14 is secured to the casing 10 will be described below.

The diaphragm 14 normally lies against the base 11 of the casing 10. When the respirator shown in FIG. 1 is in use, however, each diaphragm 14 lifts away from the base 11 of its respective casing 10 when the wearer breathes in and allows air to be drawn into the respirator through the filter material 6 and the apertures 13: conversely, when the wearer breathes out, each diaphragm 14 is pressed against the base 11 of its respective casing 10 and seals the apertures 13 so that exhaled air is forced to leave the respirator through the exhalation valve 5.

Returning to FIG. 3, the diaphragm 14 is secured to the base 11 of the casing 10 by two upstanding heads 17 on the central bar 16 in the array of apertures 13. One of the heads 17 is shown in detail in FIGS. 4 and 5. Each head 17 is formed, as will be described below, from a cylindrical post 18 (shown in FIG. 6) which is moulded in one piece with the casing 10. The diaphragm 14 has two apertures 19 (FIG. 7) positioned to correspond to the locations of the two posts 18 and is placed in position on the base 11 before the heads 17 are formed.

Figure 4:
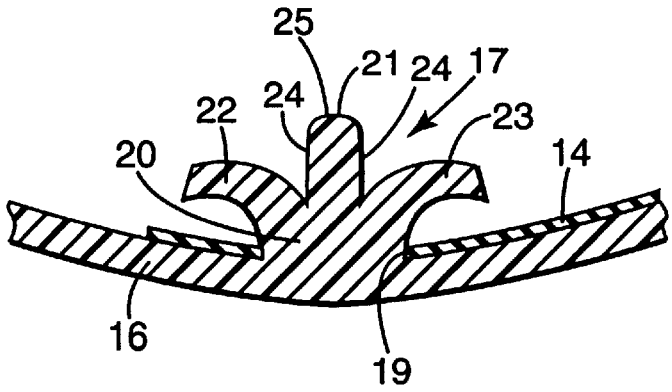
FIG. 4 is an enlarged cross-section through a component of the filter assembly, on the line IV–IV in FIG. 3.
Figure 5:
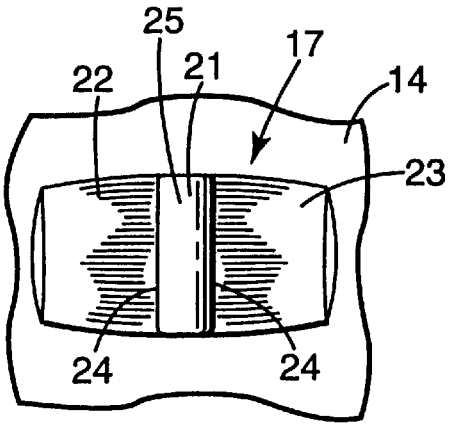
FIG. 5 is a plan view of the component shown in FIG. 4.
Figure 6:
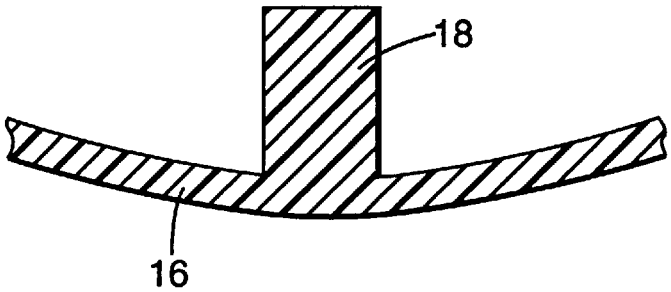
FIG. 6 corresponds to FIG. 4 but shows the component in its original state.

As shown in FIGS. 4 and 5, each head 17 in its final form comprises a base portion 20 (adjacent the central bar 16 in the array of apertures 13) which is located in one of the apertures 19 in the diaphragm 14. The major part of the head 17 (i.e. on the side of the diaphragm 14 remote from the bar 16) is divided into three sections: a central section 21 which extends upwards from the base portion 20 and, on each side of the central section, two outer sections 22, 23. The central section 21 corresponds to a diametric section of the original cylindrical post 18 and has parallel, flat, side faces 24 and a rounded upper surface 25. The outer sections 22, 23 each join the central section 21 at the lower edge of the adjacent side face 24, but bend outwards from the central section so that they extend over the diaphragm 14 and thereby retain it in position on the base 11 of the casing 10. Each of the outer sections 22, 23 has the same width as the adjacent side face 24 of the central 21 where it joins the latter but narrows slightly towards its outer end as can be seen from FIG. 5.

A head 17, having the shape just described and shown in FIGS. 4 and 5, is formed from a cylindrical post 18 by shearing the post longitudinally from the end along two generally parallel lines (thus dividing the post into the central section 21 and the outer sections 22, 23) and simultaneously bending each of the outer sections 22, 23 outwards away from the central section 21 into the configuration shown in FIG. 4. That cutting and deforming step is carried out using the tool 30 shown in FIGS. 8 to 11.

The tool 30 comprises two parallel cutting edges 31, 32 between which is a channel 33 which extends into the tool away from the cutting edges. The base 34 of the channel is curved in both the longitudinal and transverse directions, as indicated in the enlarged views of FIGS. 10 and 11, and corresponds in shape to the rounded upper surface 25 of the central section 21 of the head 17. Extending outwardly from each cutting edge 31, 32 is a respective curved surface 35, 36 each of which corresponds in shape to the outer sections 22, 23 of the head 17. It will be apparent that, if the tool 30 is applied in a longitudinal direction to the cylindrical post 18 of FIG. 6, the cutting edges 31, 32 will shear the post longitudinally into the central section 21 and two outer sections 22, 23 and, simultaneously, will bend the latter outwards into the configuration shown in FIGS. 4 and 5. As the outer sections 22, 23 are being bent, the central section 21 of the tool enters the channel 33 between the cutting edges and, when the top of the central section encounters the base 34 of the channel, it is deformed into a rounded shape to give the completed head 17 a finished appearance while, at the same time, the whole head 17 is pushed down and spread out slightly in a transverse direction.

It has been found that the heads 17 are very effective in maintaining the diaphragm 14 in position on the filter assembly 3. They are, however, quick and easy to form and enable the rate at which respirators can be completed to be increased significantly, without requiring highly skilled operators to carry out the assembly process. For the heads 17 to be most effective in holding the diaphragm 14 in position, the cutting edges 31, 32 of the tool should cut as far as possible into the cylindrical post 18 (so that the outside sections 22, 23 of the heads have as great a spread as possible) without disturbing the diaphragm so that the latter will continue to sit flat against the apertures 13. In the case, for example, in which the posts 18 have a diameter of about 3.3 mm and a height of about 3.5 mm, and the diaphragm 14 has a thickness of 0.55 mm, it has been found possible to cut almost to the base of the posts without disturbing the diaphragm.

It will be appreciated that the central section 21 of a head 17 as described above does not perform any function with regard to holding the diaphragm 14 in position and that the diaphragm could, for example, be held simply by forming one central split in the cylindrical post 18 and bending each half of the post outwards. In that case, the tool required to carry out the cutting and bending operation would not include the channel 33 shown in FIGS. 8 to 11 but would comprise a single cutting edge, centrally-located between two outwardly-extending curved surfaces which correspond in shape to the final shape of the two halves of the post. The cylindrical post 18 must, however, then be thin enough to ensure that the two halves of the post can be deformed and there is then a risk that the post will be too thin to be cut satisfactorily and will be damaged by the cutting tool. That risk can be avoided by using a thicker cylindrical post and cutting it as described above with reference to FIGS. 4 and 5.

Figure 8:
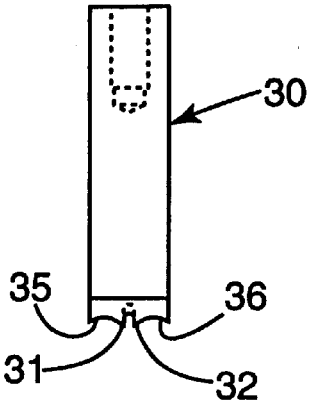
FIG. 8 is a side view of the tool used to form the component shown in FIGS. 4 and 5.
Figure 9:
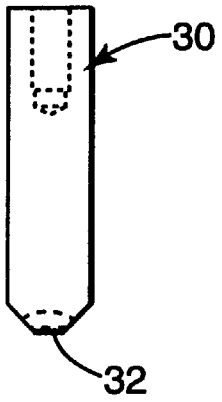
FIG. 9 is another side view of the tool, in a direction at right angles to FIG. 7.
Figure 10:
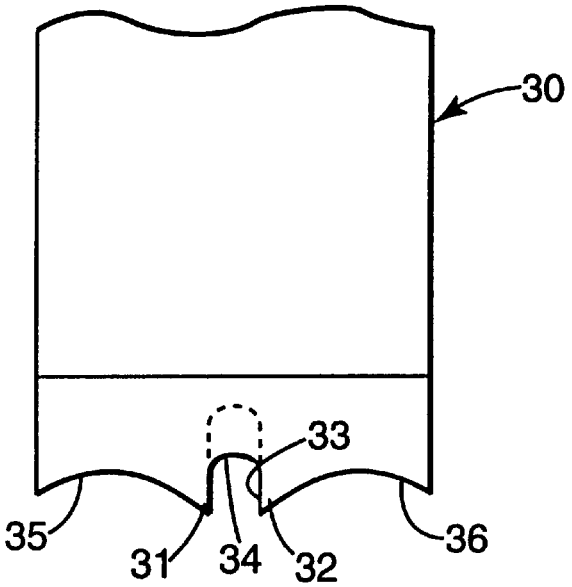
FIGS. 10 and 11 are enlarged views of parts of FIGS. 8 and 9, respectively.
Figure 11:
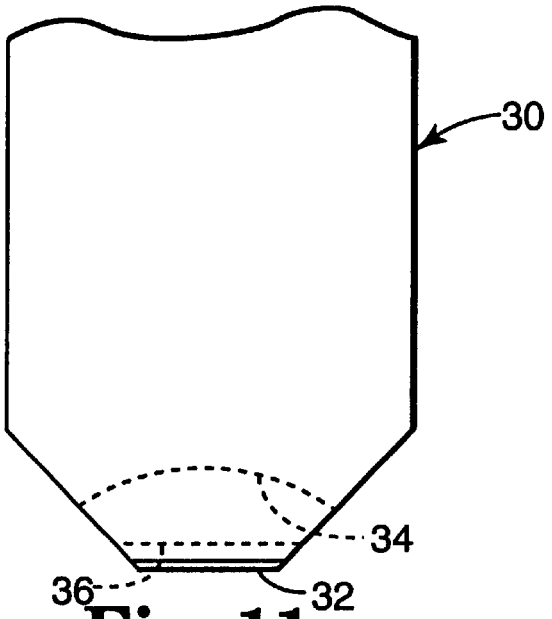

It is, of course, not essential for the cutting tool of FIGS. 8 and 9 to be shaped so that it will give a rounded shape to the top surface of the central section 21 of the head 17 but that does result in the head 17 having a more attractive finished appearance.

It is possible to form the cylindrical posts 18 on a filter assembly 3 into shapes other that shown in FIGS. 4 and 5 by cutting the posts in an alternative manner so that the portions which are bent over to hold the diaphragm 14 in position have a different shape. For example, a cutting tool with a cutting edge which defines a circle of smaller diameter than the post 18 could be used to cut and deform a head having a peripheral region of the post to yield a generally circular central section and a surrounding outer section of larger diameter than the original post. The shape shown in FIGS. 4 and 5 is preferred, however, because it has a greater spread and is particularly effective in holding the diaphragm 14 in position.

Although the posts 18 have a circular cross-section, it is possible to employ other cross-sectional shapes (for example, rectangular or elliptical) provided that the shape of the head of the tool 30 is adjusted accordingly.

It will be appreciated that, although the above description refers to the use of two heads 17 to secure each diaphragm 14 to the respective filter assembly 3, the number of heads used can be changed depending on the size and shape of the diaphragm. Both the size and shape of the diaphragm can be changed, depending on the size and shape of the aperture(s) that the diaphragm is required to cover. The rectangular shape described above is not essential and the diaphragm could, for example, have a circular shape instead. Depending on the size and shape of the diaphragm, only a single head may be required in some cases to secure it in position.

The above description concerns a fastening method which is employed for holding a diaphragm valve on a filter assembly of a particular type of respirator. The same fastening method could be used to secure a valve diaphragm to a valve base in other forms of respirators and, indeed, in other forms of personal respiratory protection devices including surgical masks, clean room masks, dust masks, face shields, and pressured air masks. The valve base need not be the casing of a filter assembly as in the respirator shown in FIG. 1 and could be associated with the exhalation valve, rather than the inhalation valve, of a respiratory protection device.

A fastening method in accordance with the invention could also be employed in the manufacture of personal respiratory protection devices to secure components other than valve diaphragms including, for example, headbands and eye shields. It will further be appreciated that the fastening method described above could also be used in fields other than the manufacture of personal respiratory devices and could be employed, for example, as an alternative to riveting or stacking, in many other circumstances when it is required to connect two components together.

We claim:

1. A method of connecting a valve diaphragm to a valve base, the method including the steps of:

(a) locating the diaphragm on a post formed on the base so that the post projects through the diaphragm;

(b) forming at least one longitudinally-extending cut in the projecting end of the post thereby forming at least one deformable section in that end portion; and, simultaneously (c) bending the/each deformable section of the post outwards, away from the central section, to secure the diaphragm to the base.

2. The method of claim 1 wherein step (b) comprises forming two, generally parallel, longitudinally-extending cuts in the projecting end of the post thereby forming, in that end portion, a central section between the cuts and two deformable outer sections, one on each side of the central section.

3. The method of claim 1 wherein the casing is a moulded plastics component and the post is formed integrally therewith.

4. The method of claim 1 wherein the valve base is a valve casing of a personal respiratory protection device.

5. An assembly comprising first and second components, wherein said first component is a valve base and said second component is a valve diaphragm, which are secured together by a post which is retained in a first one of the components and projects through the second component, the projecting end of the post being slit longitudinally into a central section and two deformable outer sections, one on each side of the central section, the deformable sections being bent outwards away from the central section to secure said components together.

* * * * *